US008136607B2

(12) United States Patent
Frauhammer et al.

(10) Patent No.: US 8,136,607 B2
(45) Date of Patent: Mar. 20, 2012

(54) DEVICE HAVING A TORQUE-LIMITING UNIT

(75) Inventors: Karl Frauhammer, Leinfelden-Echterdingen (DE); Gerhard Meixner, Filderstadt (DE); Heinz Schnerring, Dettenhausen (DE)

(73) Assignee: Robert Bosch GmbH, Stuttgart (DE)

( * ) Notice: Subject to any disclaimer, the term of this patent is extended or adjusted under 35 U.S.C. 154(b) by 1282 days.

(21) Appl. No.: 11/157,019

(22) Filed: Jun. 20, 2005

(65) Prior Publication Data

US 2005/0284648 A1 Dec. 29, 2005

(30) Foreign Application Priority Data

Jun. 25, 2004 (DE) ..... 10 2004 030 760

(51) Int. Cl.
*B25B 23/151* (2006.01)

(52) U.S. Cl. ..... 173/104; 173/5; 173/176; 173/178; 173/180; 173/48; 192/139; 192/141; 192/144; 192/150

(58) Field of Classification Search ..... 173/104, 173/5, 176, 178, 180, 48; 192/139, 141, 192/144, 150
See application file for complete search history.

(56) References Cited

U.S. PATENT DOCUMENTS

| | | | | |
|---|---|---|---|---|
| 3,165,014 | A * | 1/1965 | Grabovac | 81/483 |
| 3,270,594 | A * | 9/1966 | Grabovac | 81/483 |
| 3,581,606 | A * | 6/1971 | Grabovac | 81/483 |
| 3,828,863 | A * | 8/1974 | Bleicher et al. | 173/48 |
| 4,429,775 | A * | 2/1984 | Teramoto | 477/178 |
| 4,655,104 | A * | 4/1987 | Blattner | 81/483 |
| 4,901,610 | A * | 2/1990 | Larson et al. | 81/473 |
| 5,060,733 | A * | 10/1991 | Kress | 173/178 |
| 5,545,109 | A * | 8/1996 | Hayakawa | 477/178 |
| 5,546,816 | A * | 8/1996 | Jansson et al. | 73/862.21 |
| 5,588,496 | A * | 12/1996 | Elger | 173/178 |
| 6,035,945 | A * | 3/2000 | Ichijyou et al. | 173/48 |
| 6,045,303 | A * | 4/2000 | Chung | 408/124 |
| 6,085,849 | A * | 7/2000 | Scigliuto | 173/178 |
| 6,142,242 | A * | 11/2000 | Okumura et al. | 173/48 |
| 6,142,243 | A | 11/2000 | Mayer | |
| 6,305,481 | B1 * | 10/2001 | Yamazaki et al. | 173/178 |
| 6,536,537 | B1 * | 3/2003 | Sasaki et al. | 173/178 |
| 6,698,530 | B2 * | 3/2004 | Hecht | 173/48 |
| 6,745,883 | B2 * | 6/2004 | Eto et al. | 192/56.62 |
| 6,929,074 | B1 * | 8/2005 | Lai | 173/178 |
| 6,976,545 | B2 * | 12/2005 | Greitmann | 173/104 |
| 2002/0096342 | A1 | 7/2002 | Milbourne | |
| 2002/0096343 | A1 | 7/2002 | Potter et al. | |

FOREIGN PATENT DOCUMENTS

| | | |
|---|---|---|
| CN | 2090306 | 12/1991 |
| DE | 198 09 131 | 9/1999 |
| EP | 0437060 | 12/1990 |
| EP | 1481768 | 12/2004 |
| EP | 1555091 | 7/2005 |
| GB | 2 334 909 | 9/1999 |
| GB | 2334909 | 9/1999 |
| GB | 2334910 | 9/1999 |
| GB | 2372720 | 9/2002 |
| GB | 2373465 | 9/2002 |
| WO | 03017857 | 3/2003 |

* cited by examiner

*Primary Examiner* — Thanh Truong
*Assistant Examiner* — Michelle Lopez
(74) *Attorney, Agent, or Firm* — Michael J. Striker

(57) ABSTRACT

A device has a torque-limiting unit of a power drill, wherein torque-limiting unit is intended to limit a screwdriving moment in a screwdriving function; and a power drill is provided with the new torque-limiting unit.

11 Claims, 4 Drawing Sheets

DEVICE HAVING A TORQUE-LIMITING UNIT

BACKGROUND OF THE INVENTION

The invention is based on a device having a torque-limiting unit.

Furnishing a device with a torque-limiting unit in a power drill has already been proposed. Such torque-limiting units are integrated into very powerful power drills embodied as jackhammers and are embodied as a safety overlock coupling, which is intended to prevent the power drill from sliding away from a user in the hammer drilling mode of the power drill, for instance if a drilling tool suddenly seizes, and the user must suddenly withstand the torque generated by the power drill. As a result, potential risks to the user can be eliminated.

SUMMARY OF THE INVENTION

It is therefore an object of the present invention to provide a device having a torque-limiting unit in a power drill, which eliminates the disadvantages of the prior art.

In accordance with the present invention, it is proposed that the torque-limiting unit is intended to limit a screwdriving torque, or moment, in a screwdriving function. As a result, advantageously, damage to a workpiece and/or a screw, which is being inserted with the power drill in the screwdriving function, can be avoided.

It can be attained that even especially powerful powerdrills can be equipped with a screwdriving function. For instance, a screwdriving function can be integrated with a powerful drilling hammer, so that it is possible to drill a dowel hole with a hammer drilling function and subsequently screw in a screw with a screwdriving function, without having to change to a different power tool. Moreover, screwdriving with a defined tightening moment can be made possible, making a fixedly specified penetration depth attainable.

The term "intended" should be understood in this context also to mean "designed" and "equipped". As the power drill, hammer drilling tools, drill hammers, and chisel hammers can for instance be considered.

In one feature of the invention, it is proposed that it has an adjustable limiting torque, or moment. As a result, a torque-limiting unit that can be adapted flexibly to specific applications can be attained. However, embodiments of the nvention in which the torque-limiting unit has a fixed torque are also conceivable. A tightening torque in the screwdriving function can be metered especially precisely if the limiting torque, or moment is continuously variably adjustable.

Besides the limiting torque, or moment, which determines the tightening torque of a screw, the torque-limiting unit may also determine screwdriving torque that occur in intermediate stages of a screwdriving operation. Embodiments of the invention are furthermore conceivable in which the torque-limiting unit regulates a screwdriving torque, or moment, as a function of time, for instance, or is a function of a penetration depth.

An especially sturdy embodiment of the torque-limiting unit is attainable if a limiting moment is generated by a detent moment. Moreover, it is proposed that the device includes a means for adjusting the detent moment of the torque-limiting unit, as a result of which a sturdy and at the same time flexible torque-limiting unit is attainable.

Damage to a workpiece and/or stripping of commercially available screws can be avoided if the torque-limiting unit limits a torque to a limiting moment that is less than 15 Nm.

A further gain in safety is attainable if the torque-limiting unit limits a torque to a limiting moment that is less than 10 Nm. By comparison, safety overlock couplings have a limiting moment that is markedly above 15 Nm, making an excessive penetration depth of screws and attendant damage to the workpiece and/or to a dowel unavoidable.

Especially comfortable operation of the device is attainable if the torque-limiting unit has a rotary sleeve for setting a limiting moment, which rotary sleeve is rotatably supported about an axis of rotation of a tool.

Fast, comfortable setting of the limiting moment with a single motion of the hand is attainable if the rotary sleeve is rotatable about an angular range of less than 120°. A limitation of the angular range can advantageously be attained by stop elements. The stop elements can limit the motion of the rotary sleeve in the circumferential direction either directly or indirectly by means of an axial stop. An axial stop limits an axial motion of the rotary sleeve, which is linked via a thread to a rotary motion.

Unintended axial shifting and precise settability of the limiting moment are attainable if an axial position of the rotary sleeve is determined, via a thread, by means of a rotary position of the rotary sleeve.

A sturdy embodiment of the torque-limiting unit is attainable if this torque-limiting unit is embodied as a safety overload clutch. Especially advantageously, the torque-limiting unit may be embodied integrally with an overlock coupling, which in a percussive drilling function of the power drill finds use as a safety overload clutch.

In principle, the torque-limiting unit may be part of an interchangeable drilling chuck and can thus be either detachable from the power drill or fixedly joined to it. Versions of the invention are also conceivable in which the torque-limiting unit is part of a retrofitting set for power drills.

Further advantages will become apparent from the ensuing description of the drawings. In the drawings, one exemplary embodiment of the invention is shown. The drawings, description and claims include numerous characteristics in combination. One skilled in the art will expediently consider these characteristics individually as well and put them together to make useful further combinations.

DESCRIPTION OF THE PREFERRED EMBODIMENTS

Figure 1:
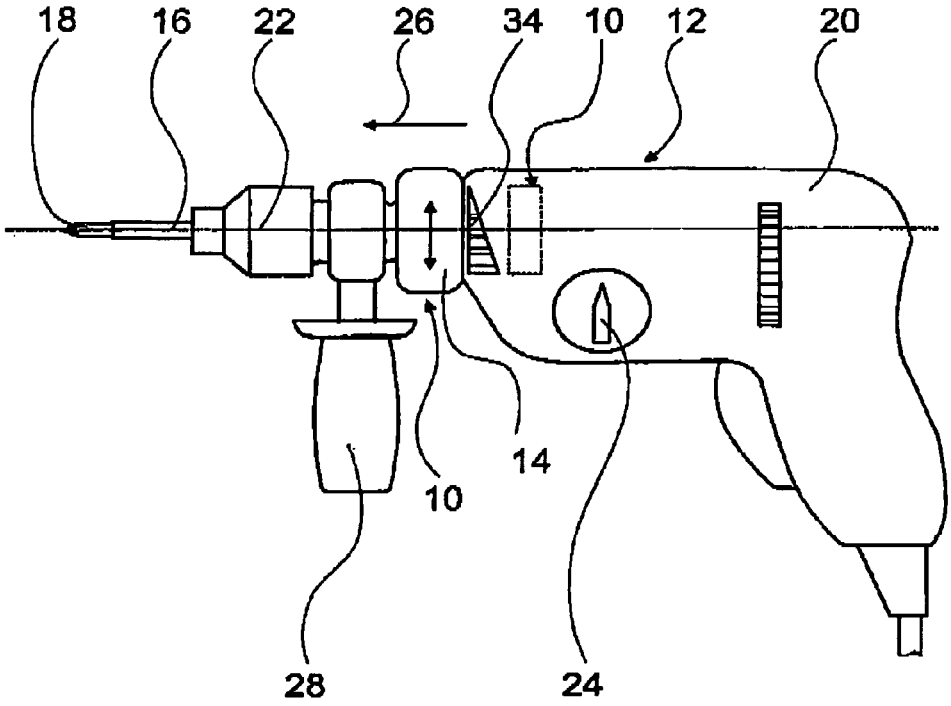
FIG. 1 shows a power drill with a screwdriving function.

FIG. 1 shows a power drill 12, embodied as a drilling hammer, which besides a hammer drilling function and a chiseling function and a drilling function has a screwdriving function. The power drill 12 has two torque-limiting units 10, specifically a safety overlock coupling not shown here and a second torque-limiting unit 10, shown in FIG. 2, which is intended for limiting a screwdriving moment by means of a limiting moment which is continuously variably adjustable in a range between about 3 Nm and 10 Nm.

The power drill 12 has a plastic body 20, in which an electric motor is located, which in the drilling hammer function, the drilling function, and the screwdriving function drives a tool chuck 22 to rotate and rotates about an axis of rotation 16 of the power drill 12. By means of a rotation selector switch 24, located on the plastic body 20, a user can determine or select the function of the power drill 12. A rotary sleeve 14 first and then following it in the working direction 26 a handlebar 28 are secured between the plastic body 20 and the tool chuck 22. The rotary sleeve 14 is supported rotatably, via a thread 30, on a hammering mechanism housing 32 of the power drill 12 (see FIG. 2).

A code element 34 embodied in ramplike form is mounted on the plastic body 20 and indicates a direction of rotation to the user for increasing or decreasing the limiting moment that is settable by rotating the rotary sleeve 14.

Figure 2:
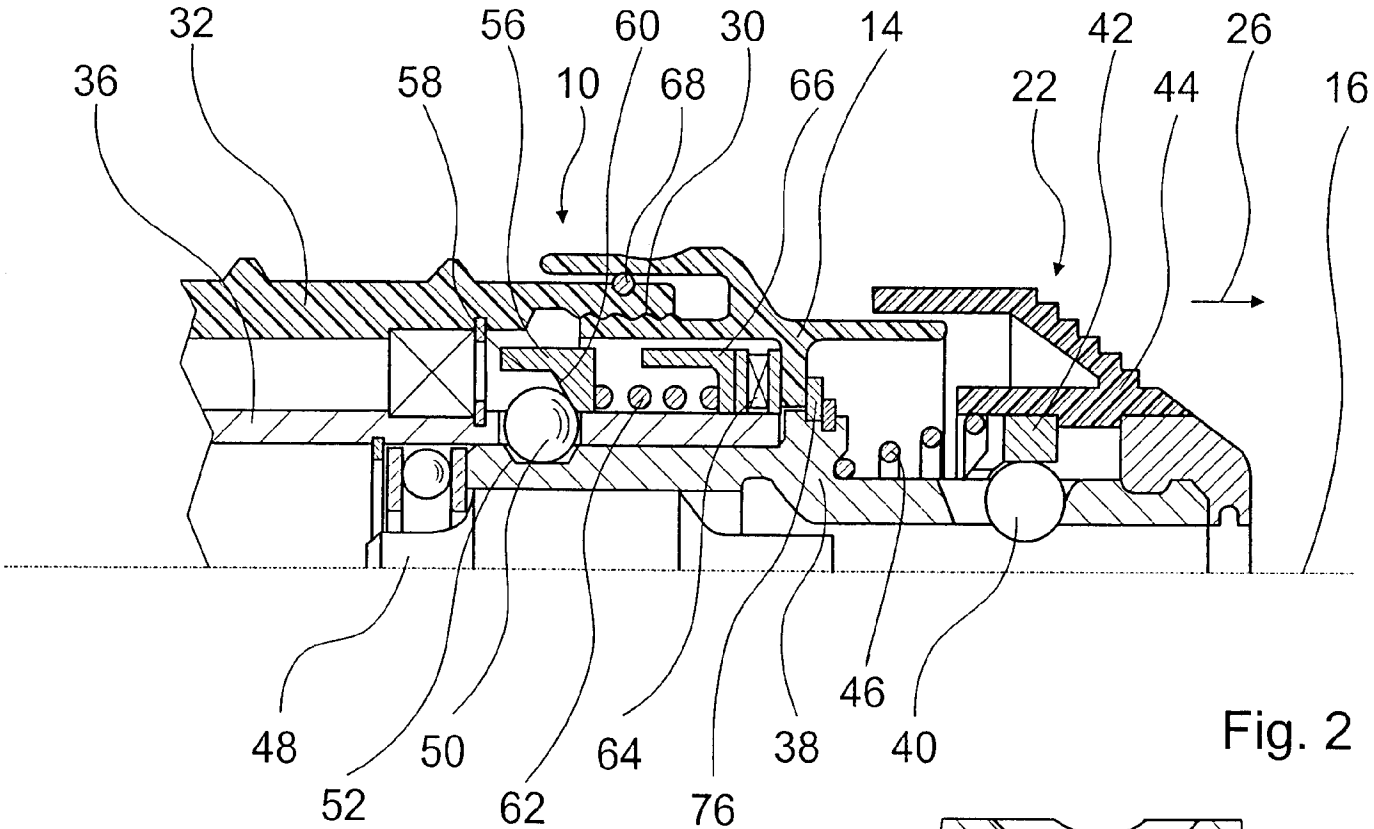
FIG. 2 shows a torque-limiting unit of the power drill of FIG. 1, in a sectional view.
Figure 3:
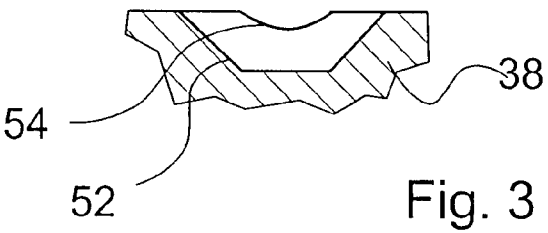
FIG. 3 shows a bearing recess of the torque-limiting unit of FIG. 2.

The hammering mechanism housing 32, a hammer barrel 36, and a tool holder 38 are shown in the sectional view in FIG. 2. The tool holder 38 is intended for supporting a tool 18 axially displaceably within limits and in a manner fixed against relative rotation. To that end, the tool holder 38 has an oblong slot, through which a ball-shaped detent body 40 can engage a recess in the tool 18. An annular locking body 42 of the tool chuck 22 is supported axially displaceably on the tool holder 38 in spring-loaded fashion and is intended for blocking a radial motion of the detent body 40. The detent body 40 and the locking body 42 lock the tool 18 in the tool chuck 22.

For unlocking, a user displaces an actuation sleeve 44 of the tool chuck 22, which sleeve is connected to the locking body 42, counter to the working direction 26 and counter to a restoring force of a spring element 46, until the locking body 42 radially releases the detent body 40, and the user can pull the tool 18 out of the tool chuck 22.

In the hammer barrel 36, a snap die 48 is supported axially movably and is intended, in a percussive drilling function and in a chiseling function of the power drill 12, to transmit axial striking pulses to the tool 18.

In a screwdriving function, a striking mechanism that drives the snap die 48 is deactivated. A user can then snap a screwdriving tool, such as a Phillips screwdriving tool, a standard screwdriving tool, a hexagonal socket screwdriving tool, a torque screwdriving tool, or other screwdriving tool that appears useful to one skilled in the art into the tool holder 38. Universal retainers are especially flexibly usable; they can be introduced by a first end into the tool holder 38 of the power drill 12, while many different screwdriver bits can be secured to their second end.

The torque-limiting unit 10 is operative between the hammer barrel 36 and the tool holder 38 and axially firmly joins the two components. A torsional strength of the connection between the hammer barrel 36 and the tool holder 38 is limited to the limiting moment by the torque-limiting unit 10.

The torque-limiting unit 10 has four ball-shaped detent bodies 50, distributed uniformly over a circumference of the hammer barrel 36, which each engage an opening in the hammer barrel 36 and, in a detent configuration, simultaneously engage a dish-shaped ball pocket 52 on the tool holder 38. Embodiments of the invention with more than four or fewer than four detent bodies distributed either uniformly or nonuniformly are also conceivable. The ball pockets 52 are joined together by a circumferential, groovelike turned indentation 54 on an outer circumference of the tool holder 38. An annular body 56 is provided for radially securing the detent bodies 50 and has an inside face which includes a cylindrical-jacketlike partial region 58 and a partial region 60 conically tapering from it in the working direction 26.

The annular body 56 is engaged by a spiral spring 62, which displaces or urges the annular body 56 axially counter to the working direction 26. One end, pointing in the working direction 26, is braced on an axial bearing 64, via a spacer sleeve 66 that fits radially over the spiral spring 62. The conical partial region 60 rests on the detent bodies 50 and deflects the spring force of the spiral spring 62 radially inward, in order to retain the detent bodies 50 in the ball pockets 52 or in the turned indentation 54 as applicable. A depth of the ball pockets 52 amounts to approximately one-fourth the diameter of the ball-shaped detent bodies 50.

The axial bearing 64 rests on a radially inward-protruding bearing flange of the rotary sleeve 14, and the rotary sleeve fits over a front rim of the tubular hammering mechanism housing 32 on the inside and outside counter to the working direction 26; the rotary sleeve 14 engages a thread 30, embodied as a female thread, that is integrally formed on the hammering mechanism housing 32. A rubber sealing ring 68 is located on an outer circumference of the hammering mechanism housing 32 and prevents dust from getting into the region of the thread 30.

Figure 4:
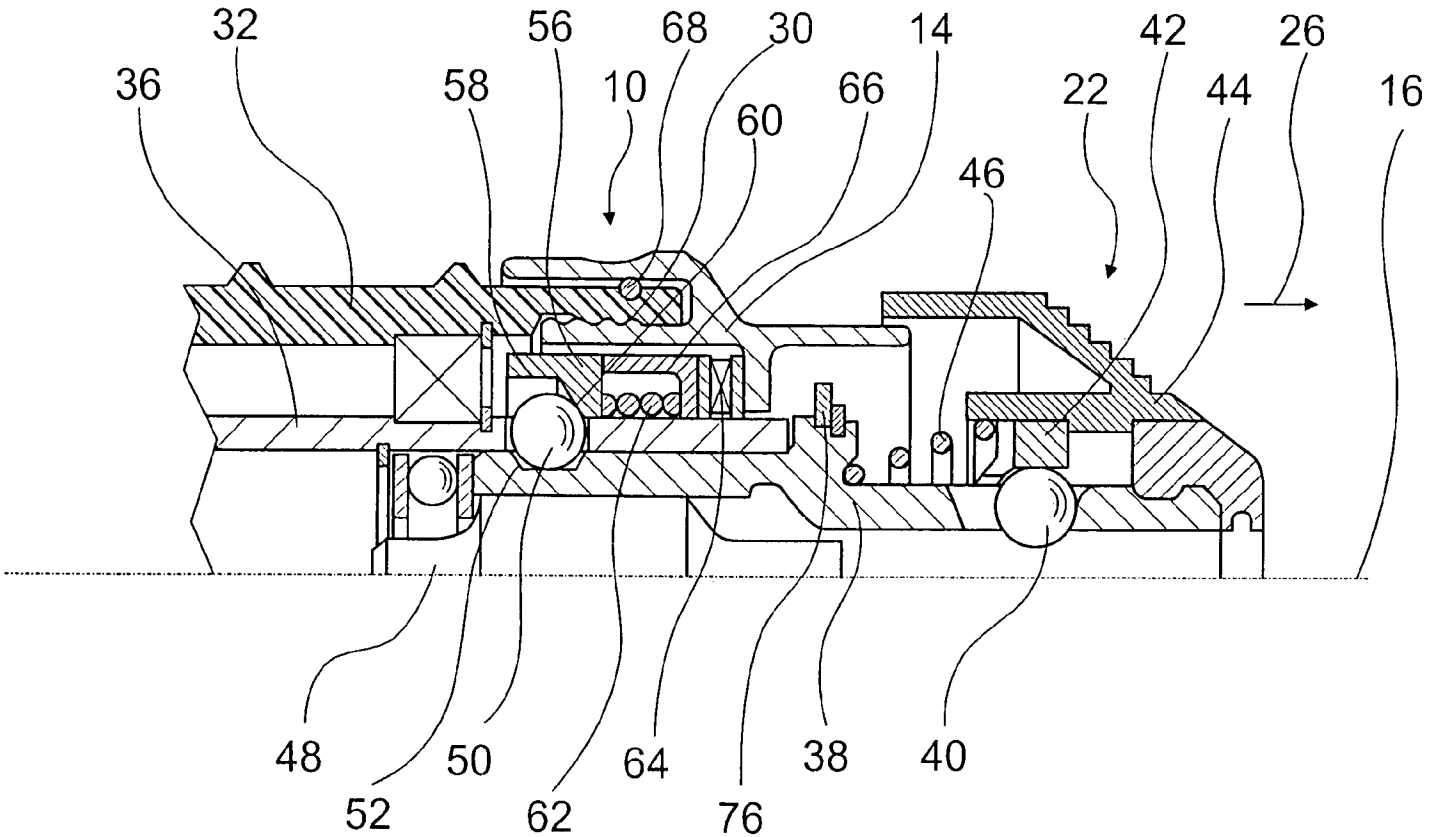
FIG. 4 shows the torque-limiting unit of FIG. 2 in a hammer drilling configuration.

If a user rotates the rotary sleeve 14 in a first direction about the axis of rotation 16, then the thread 30 steps up the rotation to an axial displacement, proportion to the rotation, of the rotary sleeve 14 counter to the working direction 26; with the rotary sleeve 14, the axial bearing 64 and the spacer sleeve 66 are also axially displaced and shift the spiral spring 62 into position. As a result, the initial tension of the spiral spring 62 is increased, and with it a limiting moment of the torque-limiting unit 10 is also increased. If the user rotates the rotary sleeve 14 in a second direction, opposite from the first, then the initial tension of the spiral spring 62 and the limiting moment decrease accordingly. In the first direction, an angular range about which the rotary sleeve 14 is rotatable is limited by the fact that a partial region, radially fitting over the spiral spring 62, of the spacer sleeve 66 strikes the annular body 56 (FIG. 4), while in the second direction the angular range is limited by the fact that the bearing flange of the rotary sleeve 14 strikes a support ring 76 (FIG. 2) that fits over the tool holder 38 and is braced on a snap ring. By means of both limitations, the angular range is limited to approximately 120°.

If in the detent configuration a torque is exerted on a tool 18 fastened in the tool holder 38, then this torque is transmitted via the detent bodies 40 and via further rotary slaving elements, not shown here, to the tool holder 38 and from there, via edges of the ball pockets 52 to the detent bodies 50 and from the detent bodies 50 via edges of the openings to the hammer barrel 36. In the process, the edges of the ball pockets 52 deflect a force component in a radial direction and displace the detent bodies 50 radially outward, whereupon the detent bodies 50, via the conical partial region 60, displace the annular bodies 56 in the working direction 26, counter to the spring force of the spiral spring 62.

If the torque exceeds the limiting moment determined by the initial tension of the spiral spring 62 and by the rotary position of the rotary sleeve 14, then the detent bodies 50 move past the edge of the ball pockets 52 into the groovelike turned indentation 54 to an overlooking configuration, and a connection between the hammer barrel 36 and the tool holder 38 in the circumferential direction is undone, until the hammer barrel 36, with the detent bodies 50 carried along in the openings, has rotated 90° under the influence of a torque of the electric motor, and the detent bodies 50 have been displaced by the spiral spring 62 and the conical partial region 60 into a further ball pocket 52. If after that a torque that exceeds the limiting moment builds up again, then the process described above begins all over again.

If the partial region of the spacer sleeve 66 that fits radially over the spiral spring 62 strikes the annular body 56 (FIG. 4), an axial displacement of the annular body 56 is blocked, making the limiting moment infinite and deactivating the torque-limiting unit 10. If the power drill 12 is operated in the hammer drilling function and the chiseling function, then the torque-limiting unit 10 should always be in this configuration.

Embodiments of the invention in which the rotary sleeve 14, in the configuration with the deactivated torque-limiting unit 10, snaps into place and/or in which the rotation selector switch 24 is mechanically blocked if the torque-limiting unit 10 is not in this configuration are conceivable.

Figure 5:
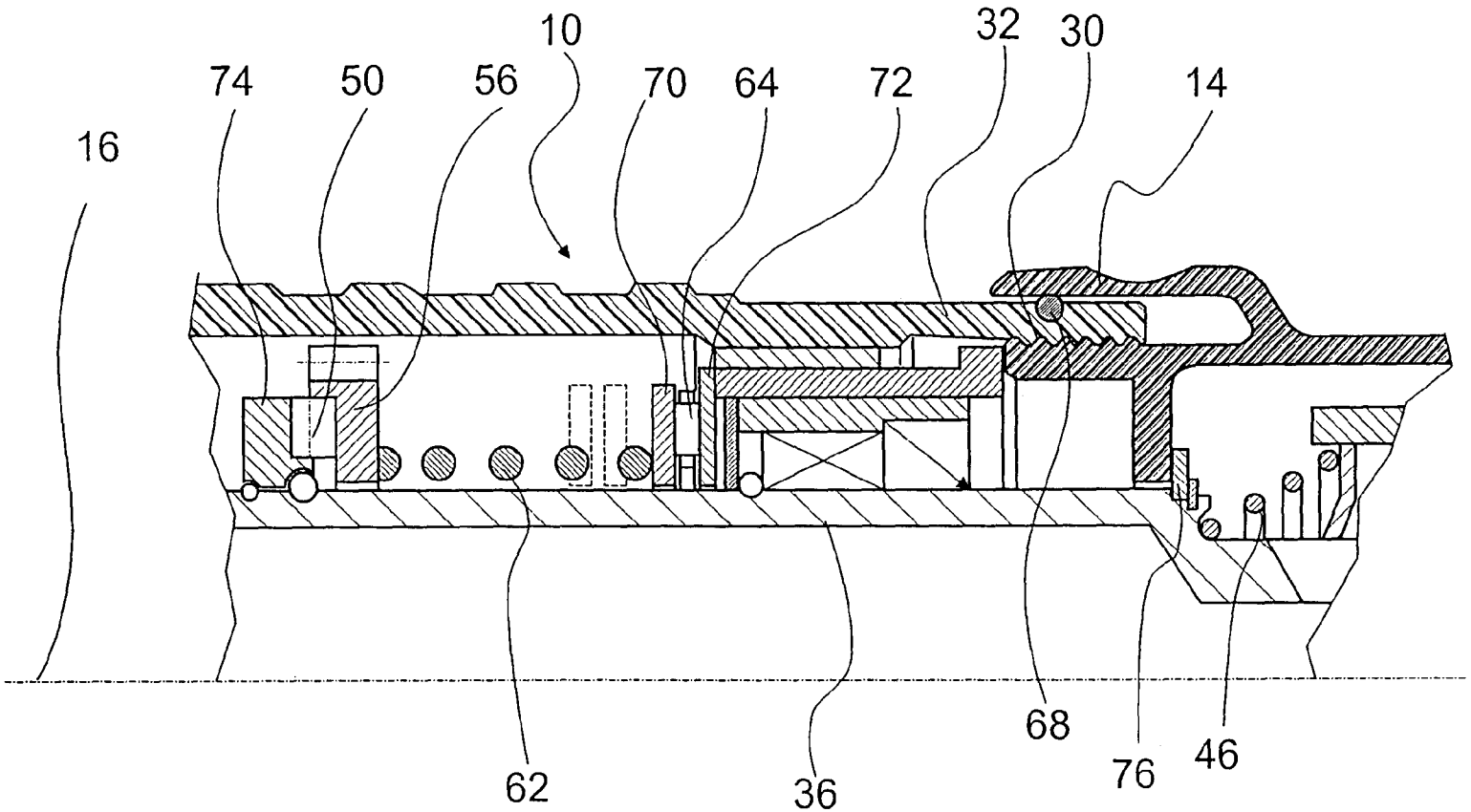
FIG. 5 shows an alternative torque-limiting unit in a sectional view.

In FIG. 5, an alternative embodiment of the invention is shown. Analogous characteristics are identified by the same reference numerals. In the description, essentially only differences from the exemplary embodiment shown in FIGS. 1 through 4 will be discussed. With regard to characteristics that remain the same, reference may be made to the description of the exemplary embodiment shown in FIGS. 1 through 4.

In the exemplary embodiment shown in FIG. 5, a safety overlock coupling is integrated with a torque-limiting unit 10 that is intended for limiting a screwdriving moment. A spiral spring 62 is braced in the working direction 26 on two disks 70, 72, between which an axial bearing 64 is seated. Counter to the working direction 26, the spiral spring 62 is braced on an annular body 56 of the torque-limiting unit 10 that has bearing pockets for detent bodies 50 on a side facing away from the working direction 26. Each of the detent bodies 50 engage a corresponding bearing pocket on a second annular body 74, joined fixedly to a hammer barrel 36, of the torque-limiting unit 10. The annular body 56 furthermore has a toothing on its circumference that meshes with a corresponding toothing on a drive shaft, not shown here, and couples the annular body 56 to the drive shaft in such a way that it is fixed against axial rotation but is displaceable axially within limits.

The disk 72 is braced in the working direction 26 on a spacer sleeve 66, which in turn is braced on a rotary sleeve 14, by way of which an initial tension of the spiral spring 62 can be set, analogously to the exemplary embodiment of FIGS. 1 through 4.

If a torque that exceeds a limiting moment determined by the initial tension of the spiral spring 62 or by the rotary position of the rotary sleeve 14 is transmitted via the torque-limiting unit 10, then the connection, generated by the detent bodies 50, of the annular bodies 56, 74 is undone, and the annular bodies 56, 74 spin. By means of rotating the rotary sleeve 14, the limiting moment can be adjusted continuously. In a first rotary position, shown in FIG. 5, the limiting moment amounts to approximately 15 Nm, and the torque-limiting unit 10 functions as a safety overlock coupling. Between a second and third rotary position, the latter shown in dashed lines in FIG. 5 as an axial position of the disk 70 associated with the corresponding rotary position, there is a limiting moment in the range of tightening torques between 5 Nm and 10 Nm, which are typically advantageously usable in dry construction. A code element, not shown here, on a plastic body of the power drill that includes the device marks the corresponding rotary positions in a way that is clearly apparent to the user.

It will be understood that each of the elements described above, or two or more together, may also find a useful application in other types of constructions differing from the types described above.

While the invention has been illustrated and described as embodied in a device having a torque-limiting unit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A power drill comprising, a motor for creating torque, a hammer barrel, a tool holder for receiving screwdriver bits to provide for a screwdriving function and for receiving drill bits to provide for a percussive drilling function, a snap die, a torque-limiting unit having means for limiting a screwdriving torque in the screwdriving function to a continuously variably adjustable limiting moment that is less than 15 Nm, and which is operative between the hammer barrel and the tool holder, and further comprising a second torque-limiting unit consisting of an overload clutch, which in the percussive drilling function finds use as a safety overload clutch.

2. A power drill as defined in claim 1, wherein said torque-limiting unit has a rotary sleeve for setting a limiting torque, said rotary sleeve being rotatably supportable about an axis of rotation of a tool and wherein said torque-limiting unit comprises stop elements for limiting the motion of the rotary sleeve in a circumferential direction, wherein by means of the stop elements, the rotary sleeve is rotatable through an angular range of less than °120.

3. A power drill according to claim 2, wherein said rotary sleeve is formed so that an axial position of said rotary sleeve is determined, via a thread, by a rotary position of said rotary sleeve.

4. A power drill according to claim 1, wherein said torque-limiting unit is embodied as an overlock coupling.

5. A power drill as defined in claim 1, comprising a selector switch for selecting between the percussive drilling function and the screwdriving function by a user.

6. A power drill as defined in claim 1, further comprising a striker mechanism, wherein the striking mechanism has a housing, and comprising a rotary sleeve for setting a limiting torque, said rotary sleeve being supported rotatably on said housing of the striking mechanism.

7. A power drill as defined in claim 1, further comprising a rotary sleeve for setting a limiting torque and a striking mechanism, and wherein the striking mechanism has a housing and said rotary sleeve engages a thread that is formed on said housing of the striking mechanism.

8. A power drill as defined in claim 1, wherein the torque-limiting unit has detent bodies, wherein each of the detent bodies engages an opening in the hammer barrel.

9. A power drill as defined in claim 1, wherein the torque-limiting unit has a detent configuration, an overload configuration and detent bodies, which move from the detent configuration into the overload configuration, when a torque exerted on a tool exceeds the limiting torque.

10. A power drill as defined in claim 1, wherein the overload clutch has a limiting moment above 15 Nm.

11. A power drill as defined in claim 1, wherein the torque-limiting unit also has means for deactivating the torque-limiting unit for use in the percussive drilling function.

* * * * *